US007234537B2

(12) United States Patent
Johnson

(10) Patent No.: US 7,234,537 B2
(45) Date of Patent: Jun. 26, 2007

(54) SONIC DRILL

(75) Inventor: Garrick Ross Johnson, Christchurch (NZ)

(73) Assignee: Bantry Limited, Christchurch (NZ)

( * ) Notice: Subject to any disclaimer, the term of this patent is extended or adjusted under 35 U.S.C. 154(b) by 176 days.

(21) Appl. No.: 10/522,104

(22) PCT Filed: Jul. 23, 2003

(86) PCT No.: PCT/NZ03/00158

§ 371 (c)(1),
(2), (4) Date: Jan. 24, 2005

(87) PCT Pub. No.: WO2004/009298

PCT Pub. Date: Jan. 29, 2004

(65) Prior Publication Data

US 2006/0162961 A1 Jul. 27, 2006

(30) Foreign Application Priority Data

Jul. 24, 2002 (NZ) ..... 516798

(51) Int. Cl.
*E21B 7/24* (2006.01)

(52) U.S. Cl. ..... 175/1; 173/142

(58) Field of Classification Search ..... 175/1, 175/56, 171; 173/90, 114, 136, 137, 142; 91/234

See application file for complete search history.

(56) References Cited

U.S. PATENT DOCUMENTS 2,763,060 A * 9/1956 Swanson ..... 30/228
2,821,962 A * 2/1958 Swanson ..... 173/102
3,375,884 A 4/1968 Bodine, Jr.
3,379,263 A 4/1968 Bodine, Jr.
3,680,442 A * 8/1972 Kanning ..... 91/234
3,736,843 A * 6/1973 Leibundgut ..... 91/234
4,308,924 A * 1/1982 Boguth ..... 173/135
4,527,637 A 7/1985 Bodine
4,836,299 A 6/1989 Bodine
5,209,564 A * 5/1993 Manci et al. ..... 366/124
5,222,425 A 6/1993 Davies
5,392,865 A 2/1995 Piras
5,417,290 A 5/1995 Barrow
5,549,170 A * 8/1996 Barrow ..... 175/55
5,562,169 A 10/1996 Barrow
5,806,608 A * 9/1998 DuBois ..... 173/90
5,884,713 A * 3/1999 Shinohara et al. ..... 173/206
6,378,951 B1 * 4/2002 Bouyoucos et al. ..... 299/37.2

FOREIGN PATENT DOCUMENTS

GB 2345931 7/2000
WO 01/83933 11/2001

* cited by examiner

*Primary Examiner*—Jennifer H. Gay
*Assistant Examiner*—Daniel P Stephenson
(74) *Attorney, Agent, or Firm*—D. Peter Hochberg; Sean Mellino

(57) ABSTRACT

A sonic drilling apparatus having a work piston within a cylinder chamber to provide a vibratory force through the alternate application of fluid under pressure into the bore above and below the piston in a manner that the piston will be forced to reciprocate within the bore. The cylinder chamber includes an inlet gallery to allow fluid under pressure to pass into the bore above a first face of the work piston and an exhaust gallery to allow fluid to escape from the bore below the second face of the work piston. A relief bypass is provided to prevent excessive build up of pressure in the bore during the reciprocating movement of the work piston.

10 Claims, 3 Drawing Sheets

SONIC DRILL

BACKGROUND TO THE INVENTION

Sonic drilling is a technique of driving a mandrel or a pipe into the ground such as an earthen formation or into a semi solid object by creating a vibratory force and applying the vibrations generated to the mandrel. The vibratory force generally consists of strong sinusoidal sonic vibrations up to approximately 200 Hz which are tuned to or close to the resonant frequency of the mandrel. The effect of the sonic vibrations is to fluidize a portion of the earth immediately surrounding the mandrel and when a load is applied to the mandrel, the sonic vibrations will facilitate the passage of the mandrel into the earthen formation. The soil surrounding the mandrel does not form part of the resonantly vibrating system and instead the particles of the soil assume a random vibration relative to each other and this fluidization will initially facilitate the passage of the mandrel through the earth formation, and eventually lead to compaction of the soil around the mandrel when the vibrations are removed.

PRIOR ART

Resonant sonic drilling generally consists of a drill head which includes a form of oscillator which can generate longitudinal sinusoidal pressure waves which are transmitted to a mandrel which has a drill bit or similar at the free end of the mandrel. Various means of generating the pressure waves for application to the mandrel are known and one such means is disclosed in U.S. Pat. No. 5,417,290 (Barrow). This specification describes a sonic head which includes a pair of eccentric rollers which revolve at a high speed in a counter rotating direction within orbital races contained in the head. The sonic head is fixed to the top of a mandrel and the energy impulses created are thereby transmitted to the mandrel.

Other methods of creating and utilising sonic energy for application to a mandrel are also disclosed in U.S. Pat. Nos. 3,375,884 (Bodine); U.S. Pat. No. 3,379,263 (Bodine); U.S. Pat. No. 4,836,299 (Bodine), U.S. Pat. No. 4,527,637 (Bodine); U.S. Pat. No. 5,549,170 (Barrow); and U.S. Pat. No. 5,562,169 (Barrow) and WO01/83933 (Bar-Cohen).

All of the above devices utilize a mechanical means such as counter-rotating rollers to generate the sinusoidal pressure waves and as such are prone to an undesirable amount of down time because of frictional problems and the high mechanical loading imparted to the componentry.

Another method of generating the sinusoidal pressure waves is described in WO 01/83933. The method consists in utilising piezoelectric stack as an actuator for generating the vibrations

OBJECT OF THE INVENTION

It is therefore an object of this invention to provide an improved means of generating sinusoidal pressure waves utilising a high pressure fluid acting directly on a piston within a cylinder.

DISCLOSURE OF THE INVENTION

In one form the invention comprises apparatus for generating sinusoidal pressure waves for application to a mandrel, said apparatus including a cylinder including a chamber which has a bore, an inlet gallery and an exhaust gallery, a work piston adapted to have reciprocal movement in the bore of the chamber and having a radial wall which will seal against the wall of the bore of the chamber during its reciprocal movement within the chamber, the work piston having a first land at one end of the work piston and a second land at the second end of the work piston, means to alternately duct fluid under pressure from the inlet gallery into the bore of the cylinder above the first land of the work piston and be exhausted from the bore below the second land of the piston into the exhaust gallery to move the work piston within the bore, and to duct fluid under pressure from the inlet gallery into the bore of the cylinder below the second land of the work piston and be exhausted from the bore above the first land of the piston into the exhaust gallery to reciprocate the piston within the bore, a piston shaft connected to the work piston and adapted to transmit the forces generated by the reciprocatory motion of the piston to a mandrel.

Preferably each inlet gallery of the piston has an inlet port to enable pressurised fluid to enter the gallery, said inlet gallery communicating with the bore of the cylinder through a port which terminates at the surface of the wall of the bore.

Preferably the chamber includes a relief bore having a first end open to the bore of the cylinder above the first radial face of the work piston and having a second end open to the bore of the cylinder below the second radial face of the work piston, said relief bore including a reciprocatable relief piston, the movement of which is determined by the movement of fluid into and out of the relief bore from the cylinder chamber.

Preferably the apparatus includes a relief bore located in the chamber, a relief piston located in the relief bore and adapted to have reciprocal movement within the bore and to seal against the wall of the relief bore during its reciprocal movement, a first relief bypass which communicates with the portion of the bore of the cylinder at one end of the work piston and with the relief bore at one end of the relief piston, a second relief bypass which communicates with the portion of the bore of the cylinder at the second end of the work piston and which communicates with the relief bore at the second end of the relief piston, the construction and arrangement being that as the work piston moves in one direction within the bore of the cylinder, fluid within the bore at a first end of the cylinder will be forced through the first relief bypass into the first end of the relief bore to move the relief piston within the relief bore to pressurize fluid within the second end of the relief bore and to move fluid through the second relief bypass into the second end of the bore of the cylinder.

Preferably each inlet gallery extends 360° around the wall of the chamber.

Preferably the body of the work piston includes a first transfer gallery extending longitudinally through the body and communicating through the radial wall of the work piston with said inlet gallery for a predetermined time during the reciprocatory movement of the work piston and also communicating with the bore of the cylinder through the first radial face of the work piston.

Preferably the body of the work piston includes a second transfer gallery extending longitudinally through the body and communicating through the radial wall of the work piston with said inlet gallery for a predetermined time during the reciprocatory movement of the work piston and also communicating with the bore of the cylinder through the second radial face of the work piston.

Preferably the chamber includes two exhaust galleries, the first exhaust gallery communicating with the cylinder chamber above the first radial face of the work piston and the second exhaust gallery communicating with the bore of the cylinder below the second radial face of the work piston, the first and second exhaust galleries including outlet ports to enable fluid within the galleries to be ducted away from the bore of the cylinder.

Preferably the location of the opening of the first transfer gallery in the radial wall of the work piston is offset longitudinally to the opening of the second transfer gallery in the radial wall of the work piston.

Preferably the cylinder is supported by a rig and the work piston includes a piston shaft which is connectable to the mandrel.

Preferably the cylinder chamber forms part of a drill head which includes a ballast weight.

BRIEF DESCRIPTION OF THE DRAWINGS

Preferred forms of the invention will now be described with the aid of the accompanying drawings wherein.

DESCRIPTION OF ONE PREFERRED EMBODIMENT OF THE INVENTION

Figure 1:
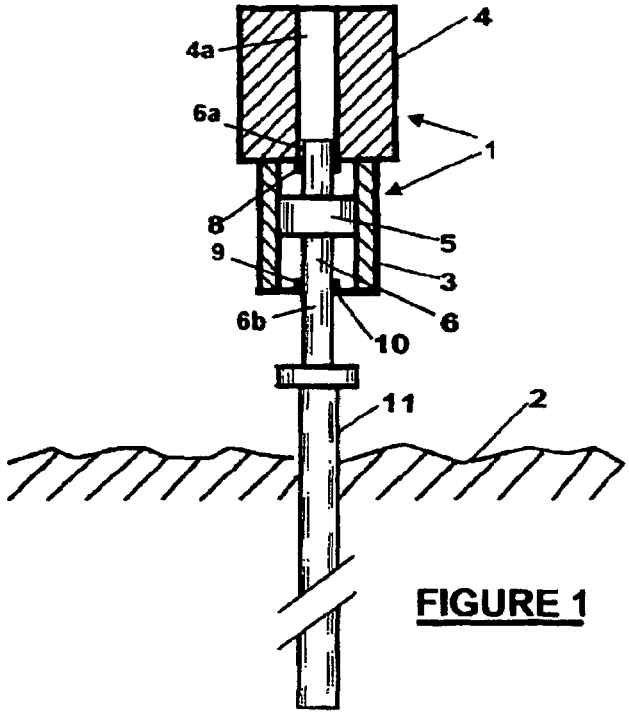
FIG. 1 is a diagrammatic view, partly in section of the basic form of the sonic drill of the present invention.

As illustrated diagrammatically in FIG. 1 of the drawings, the apparatus includes a drill head 1 which is positioned above the ground 2 and is suitably supported in a rig (not shown in the drawings) in a manner that will be apparent to those skilled in the art. The drill head includes a cylinder chamber 3 on which a ballast weight 4 is mounted. A work piston 5 has reciprocating longitudinal movement within the bore of the cylinder chamber 3 and the piston 5 is connected to a piston shaft 6 which is guided at a first end 6*a* in a sleeve 4*a* formed in the ballast weight 4. A suitable fluid seal 8 is located in the sleeve 4*a* to ensure an adequate seal between the bore of the cylinder chamber 3 and ambient. The second end 6*a* of the piston shaft 6 extends through a seal 9 located in an end plate 10 of the cylinder chamber 3 to enable the bore of the chamber below the piston 5 to be sealed from ambient. The piston shaft may be hollow to facilitate the sampling of cores as will be known in the art.

In the form illustrated in FIG. 1, the piston shaft 6 bears on or forms part of a mandrel 11 or a drill string which as illustrated is partly embedded in the ground 2. Means (not shown in the drawings) as will be apparent to those skilled in the art may also be provided to rotate the drill string or mandrel to ensure the integrity of any screwed joints that may be employed in the drill string, and also to facilitate the disassembly of the drill string and the controlled guidance of the drill string during operation.

Figure 2:
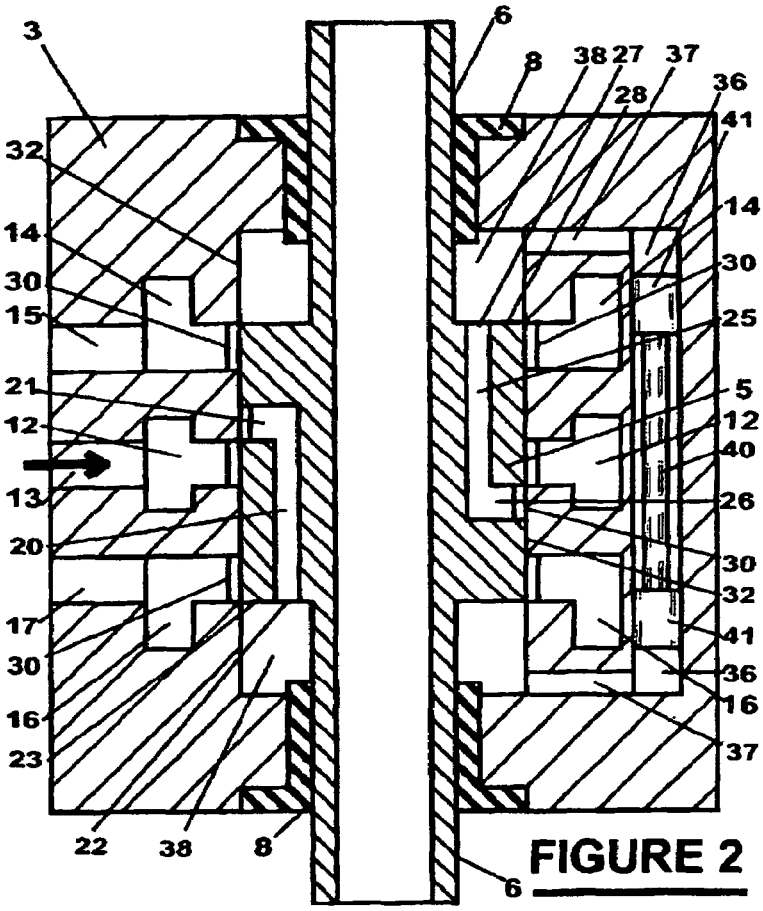
FIG. 2 is a diagrammatic sectional view illustrating a piston within the cylinder, the piston being in the neutral position.
Figure 3:
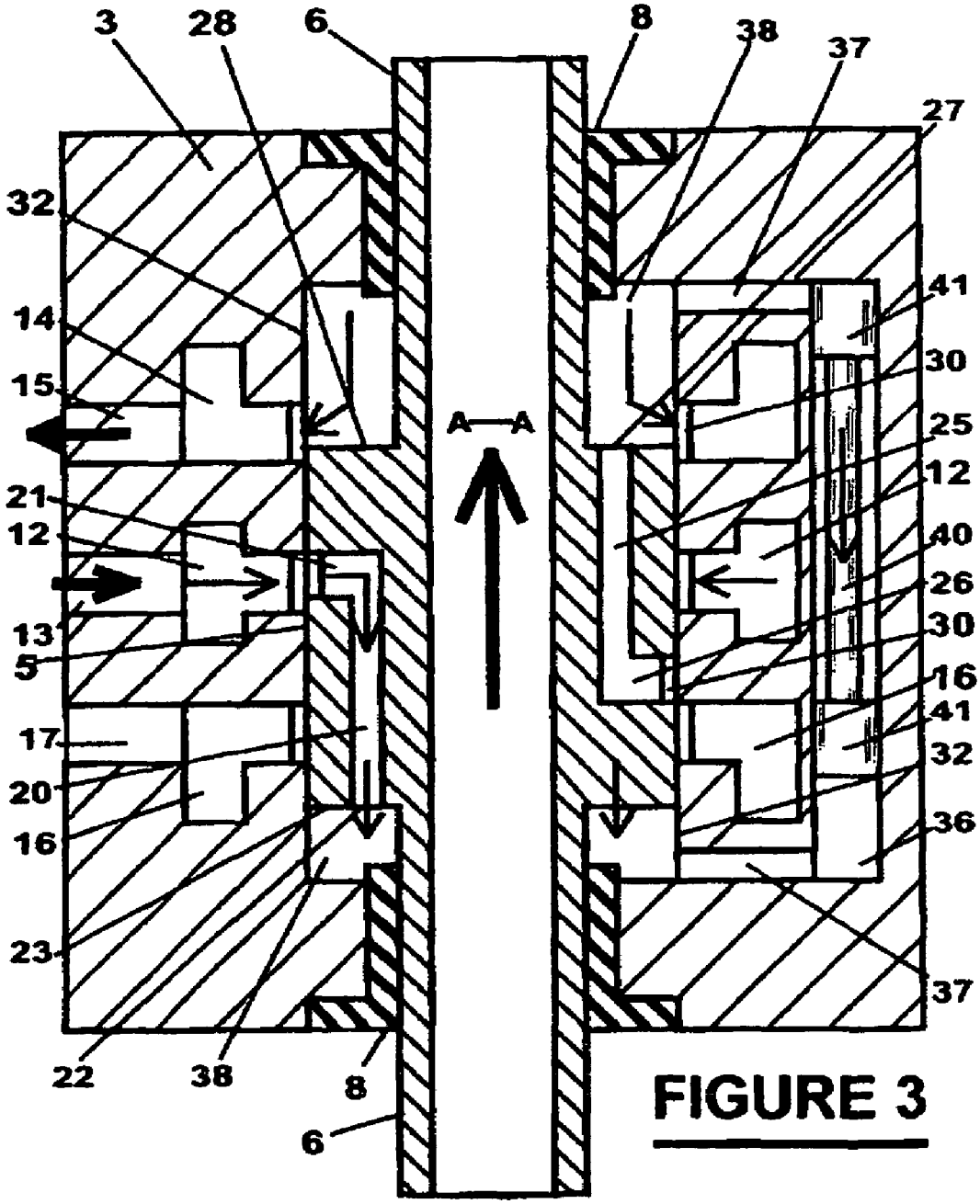
FIG. 3 is a diagrammatic view similar to FIG. 2 but illustrating the piston at the commencement of a stroke in a first direction
Figure 4:
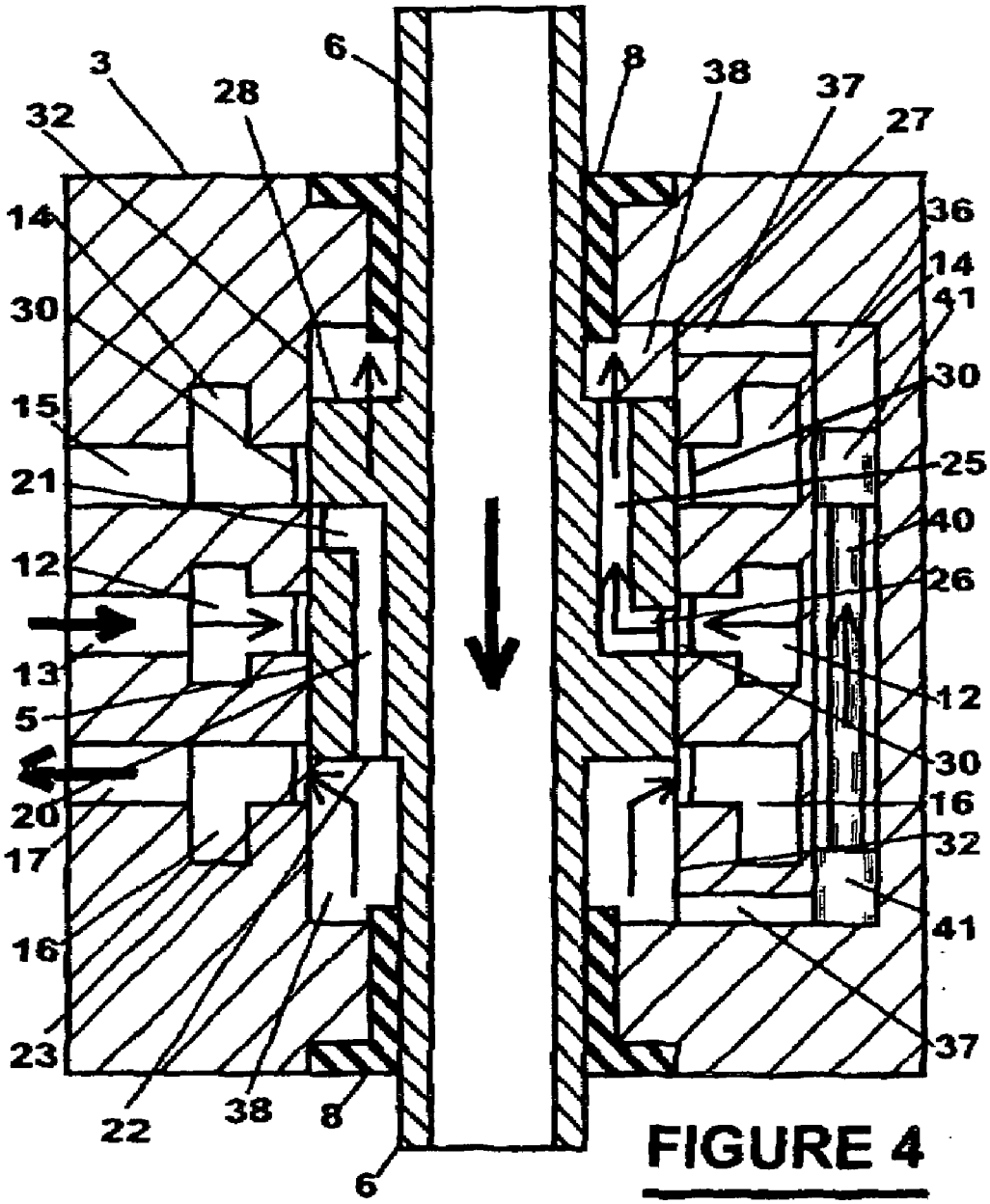
FIG. 4 is a diagrammatic view similar to FIG. 2 but illustrating the piston at the commencement of a stroke in a second direction

As specifically illustrated in FIGS. 2, 3 and 4, the cylinder chamber 3 includes an inlet gallery 12 having an inlet port 13 to which a source of high pressure fluid can be connected. The cylinder chamber also includes a first exhaust gallery 14 having an outlet port 15 and a second exhaust gallery 16 having an outlet port 17.

The work piston 5 includes a first transfer gallery 20 which can communicate with an opening 21 in the axial face of the piston 5 and which extends longitudinally through the piston to exit at 22 in the land 23 of the work piston, As illustrated, the opening 21 is offset from the longitudinal center of the piston. The piston also includes a second transfer gallery 25, one end of which is open at 26 through a port 30 in the axial wall of the piston with the other end being open at 27 in the land 28 of the piston. As in the case of the first transfer gallery 20, the opening 26 of the second transfer gallery 25 is offset from the longitudinal center of the piston an equivalent but opposite amount of distance to that of the opening 21.

The apparatus also includes a fluid by pass which in a highly preferred form comprises a bore 36 formed longitudinally in the cylinder and which communicates via a duct 37 with the cylinder chamber 38 both above and below the piston 5. A reciprocating by pass piston 40 has free longitudinal movement within the bore 36 and suitable fluid seals 41 are located at either end of the piston 40 to prevent the passage of fluid past the seals.

In operation fluid under pressure is ducted to the port 13 and passes into the inlet gallery 12 which preferably extends 360° around the cylinder wall. When the piston is in the position indicated in FIG. 3, the pressurized fluid will pass into the first transfer gallery 20 as indicated by the arrows and exit through the opening 22 in the axial face of the piston into the chamber 38. At this position the exhaust ports to the gallery 17 are closed while the exhaust ports to the gallery 14 are open so that the interior of the chamber above the piston is open to the gallery 14. It will be noted that at all times the chamber 38 both above and below the piston remain open to the ducts 37 and consequently to the bore 36.

The pressure of the fluid will act on the land 23 of the piston and this will cause the piston to move in the direction of the arrow A—A (see FIG. 3). The movement of the piston will then incrementally close the opening of the first transfer gallery 20 to the inlet gallery 12 and will incrementally close the cylinder chamber 38 to the exhaust gallery 14. When the piston has reached a stage whereby both the opening 21 of the first transfer gallery 20 to the inlet gallery 20 is closed and the chamber 38 is closed to the exhaust gallery 14, fluid within the chamber above the piston will tend to flow into the duct 37 and into the bore 36. Pressure will therefore be exerted on the end face of the by pass piston 40 which will move in the direction of the arrow. This will relieve the pressure in the chamber 38, and prevent excessive pressure build up in the chamber 38 above the piston, thereby allowing the work piston 5 to complete its stroke.

As the work piston continues movement in the direction of the arrow A—A in FIG. 3, the opening 26 of the second transfer gallery 25 will commence to register with the inlet gallery 12 and fluid under pressure will flow through the second transfer gallery 25 and out of the opening 27 in the land 28 of the piston into the chamber 38 above the piston. The upward movement of the piston will continue until the piston reaches the position illustrated in FIG. 4, at which stage the pressure of the fluid entering the cylinder chamber 38 via the opening 27 in the second transfer duct 25 will commence to force the piston back into the second cycle of the operation.

The backwards and forwards movement of the piston illustrated in FIGS. 3 and 4 will accordingly automatically continue in conjunction with the resonant spring mass system of the drill string as long as fluid under pressure obtains within the inlet gallery and the fluid is able to exit from the exhaust galleries 14 and 16. It will of course be understood that the inlet and exhaust galleries are preferably joined into a loop into which an appropriate pump is located to generate the required fluid pressure.

Depending upon the relative volumes of the component parts and on the pressure of the fluid very considerable reciprocating forces can therefore be generated with the speed of reciprocation of the piston being dependent not only on the pressure of the fluid but also on the relative timing of the porting arrangement and also on the resonant frequency of the mandrel/drill string.

It will also be understood that the preferred form of fluid will generally be hydraulic or similar oil, but the fluid can also be a gas such as air or steam which is supplied at an appropriate volume and pressure by any known pressure generating system. One such pressure generating system can for instance be a form of internal combustion engine.

Having described a preferred form of the invention, it will be apparent to those skilled in the art that modifications and amendments can be made to the specific preferred embodiments and yet still come within the general concept of the invention. All such modifications and amendments are intended to fall within the scope of this invention.

The invention claimed is:

1. An apparatus for generating sinusoidal pressure waves for application to a drill string, said apparatus including:

a cylinder including a chamber which has a bore, an inlet gallery and an exhaust gallery;

a work piston having reciprocal movement in the bore of the chamber and having a radial wall for sealing against the wall of the bore of the chamber during the reciprocal movement within the chamber;

the work piston having a first land at one end of the work piston and a second land at the second end of the work piston;

an apparatus to alternately duct fluid under pressure from the inlet gallery into the bore of the cylinder above the first land of the work piston and be exhausted from the bore of the cylinder below the second land of the piston into the exhaust gallery, and to duct fluid under pressure from the inlet gallery into the bore of the cylinder below the second land of the work piston and be exhausted from the bore above the first land of the piston into the exhaust gallery to reciprocate the piston within the bore;

a piston shaft connected to the work piston for transmitting the forces generated by the reciprocatory motion of the piston to the drill string; and a relief bore communicating with the bore of the chamber and having a first end open to the bore of the chamber above the first land of the work piston and a second end open to the bore of the chamber below the second land of the work piston;

the relief bore including a reciprocatable relief piston, wherein the movement of said reciprocatable relief piston is determined by the movement of fluid into and out of the relief bore from the bore of the chamber.

2. The apparatus for generating sinusoidal pressure waves for application to a drill string as claimed in claim 1, wherein each inlet gallery of the piston has an inlet port to enable pressurised fluid to enter the gallery, said inlet gallery communicating with the bore of the cylinder through a port which terminates at the surface of the wall of the bore.

3. The apparatus for generating sinusoidal pressure waves for application to a drill string as claimed in claim 1, further including:

a relief bore having a first end communicating with the bore of the chamber above the first land of the piston and a second end communicating with the bore of the chamber below the second land of the piston;

a relief piston located in the relief bore having reciprocal movement within the bore and able to seal against the wall of the relief bore during the reciprocal movement;

a first relief bypass for communicating with the first relief bore; and a second relief bypass for communicating with the second relief bore; wherein the construction and arrangement being that as the work piston moves in one direction within the bore of the chamber, fluid within the bore at a first end of the chamber will be forced through the first relief bypass into the first end of the relief bore to move the relief piston within the relief bore to pressurize fluid within the second end of the relief bore and to move fluid through the second relief bypass into the second end of the bore of the cylinder.

4. The apparatus for generating sinusoidal pressure waves for application to a drill string as claimed in claim 1, wherein each inlet gallery extends 360° around the wall of the chamber.

5. The apparatus for generating sinusoidal pressure waves for application to a drill string as claimed in claim 1, wherein the body of the work piston includes a first transfer gallery extending longitudinally through the body and communicating through the radial wall of the work piston with said inlet gallery for a predetermined time during the reciprocatory movement of the work piston and also communicating with the bore of the cylinder through the first radial face of the work piston.

6. The apparatus for generating sinusoidal pressure waves for application to a drill string as claimed in claim 1, wherein the body of the work piston includes a second transfer gallery extending longitudinally through the body and communicating through the radial wall of the work piston with said inlet gallery for a predetermined time during the reciprocatory movement of the work piston and also communicating with the bore of the cylinder through the second radial face of the work piston.

7. The apparatus for generating sinusoidal pressure waves for application to a drill string as claimed in claim 1, wherein the chamber includes two exhaust galleries, the first exhaust gallery communicating with the cylinder chamber above the first radial face of the work piston and the second exhaust gallery communicating with the bore of the cylinder below the second radial face of the work piston, the first and second exhaust galleries including outlet ports to enable fluid within the galleries to be ducted away from the bore of the cylinder.

8. The apparatus for generating sinusoidal pressure waves for application to a drill string as claimed in claim 1, wherein the location of the opening of the first transfer gallery in the radial wall of the work piston is offset longitudinally to the opening of the second transfer gallery in the radial wall of the work piston.

9. The apparatus for generating sinusoidal pressure waves for application to a drill string as claimed in claim 1, wherein the cylinder is supported by a rig and the work piston includes a piston shaft which is connectable to the drill string.

10. The apparatus for generating sinusoidal pressure waves for application to a drill string as claimed in claim 1, wherein the cylinder chamber forms part of a drill head which includes a ballast weight.

* * * * *